US011248441B2

(12) United States Patent
Vick, Jr. et al.

(10) Patent No.: US 11,248,441 B2
(45) Date of Patent: Feb. 15, 2022

(54) ELECTRIC SAFETY VALVE WITH WELL PRESSURE ACTIVATION

(71) Applicant: Halliburton Energy Services, Inc., Houston, TX (US)

(72) Inventors: James Dan Vick, Jr., Dallas, TX (US); Jimmie Robert Williamson, Carrollton, TX (US); Bruce Edward Scott, McKinney, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

(21) Appl. No.: 16/426,306

(22) Filed: May 30, 2019

(65) Prior Publication Data

US 2020/0032616 A1 Jan. 30, 2020

Related U.S. Application Data

(60) Provisional application No. 62/703,506, filed on Jul. 26, 2018.

(51) Int. Cl.

| | |
|---|---|
| ***E21B 34/08*** | (2006.01) |
| ***E21B 34/14*** | (2006.01) |
| ***E21B 34/06*** | (2006.01) |
| ***E21B 34/16*** | (2006.01) |
| ***E21B 34/10*** | (2006.01) |

(52) U.S. Cl.

CPC ..... *E21B 34/08* (2013.01); *E21B 34/066* (2013.01); *E21B 34/10* (2013.01); *E21B 34/14* (2013.01); *E21B 34/16* (2013.01); *E21B 2200/05* (2020.05)

(58) Field of Classification Search

CPC ..... E21B 34/066; E21B 34/08; E21B 34/10; E21B 34/102; E21B 34/14; E21B 34/16; E21B 2034/005; E21B 2200/05

See application file for complete search history.

(56) References Cited

U.S. PATENT DOCUMENTS 4,002,202 A * 1/1977 Huebsch ..... E21B 34/066 166/66.7

4,566,534 A 1/1986 Going (Continued)

FOREIGN PATENT DOCUMENTS

| | | | | |
|---|---|---|---|---|
| GB | 2337065 A | * | 11/1999 | ..... E21B 34/066 |
| GB | 2416553 A | * | 2/2006 | ..... E21B 23/04 |
| GB | 2564818 A | * | 1/2019 | ..... E21B 34/066 |

OTHER PUBLICATIONS

International Search Report and Written Opinion from PCT/US2019/034697 dated Sep. 20, 2019.

*Primary Examiner* — Jennifer H Gay

(74) *Attorney, Agent, or Firm* — Scott Richardson; C. Tumey Law Group PLLC

(57) ABSTRACT

A safety valve may include: an outer housing comprising a central bore extending axially through the outer housing; a flow tube including: a translating sleeve; and a flow tube main body disposed within the translating sleeve, wherein the flow tube main body has an upper end and a lower end; a piston operable to transmit a force to the translating sleeve; a flapper valve disposed on a distal end of the outer housing; and an electromagnet assembly operable to maintain the safety valve in an open state.

20 Claims, 3 Drawing Sheets

(56) References Cited

U.S. PATENT DOCUMENTS 4,579,177 A * 4/1986 Going, III ..... E21B 34/14 166/66.5
4,886,114 A 12/1989 Perkins et al.
5,070,944 A * 12/1991 Hopper ..... E21B 34/066 166/66.7
5,293,551 A * 3/1994 Perkins ..... H01F 7/1844 361/154
6,269,874 B1 * 8/2001 Rawson ..... E21B 34/066 166/53
6,619,388 B2 9/2003 Dietz et al.
6,626,244 B2 9/2003 Powers
6,988,556 B2 * 1/2006 Vick, Jr. ..... F16K 31/086 166/375
7,640,989 B2 * 1/2010 Williamson, Jr. .... E21B 34/066 166/332.8
8,393,386 B2 3/2013 Lake et al.
8,453,748 B2 * 6/2013 Vick, Jr. ..... E21B 34/08 166/373
8,490,687 B2 7/2013 Scott et al.
8,511,374 B2 8/2013 Scott et al.
8,919,730 B2 * 12/2014 Vick, Jr. ..... F16K 31/086 251/65
9,010,448 B2 * 4/2015 Williamson, Jr. ..... E21B 34/06 166/386
9,631,456 B2 * 4/2017 Vick, Jr. ..... F16K 31/124
9,909,387 B2 3/2018 Scott et al.
10,174,589 B2 * 1/2019 Vick, Jr. ..... F16K 31/1221
10,724,332 B2 * 7/2020 Henschel, Jr. ..... E21B 34/066
2002/0108747 A1 * 8/2002 Dietz ..... E21B 34/066 166/66.7
2007/0137869 A1 * 6/2007 MacDougall ..... E21B 34/066 166/386
2008/0053662 A1 * 3/2008 Williamson ..... E21B 34/066 166/381
2008/0157014 A1 * 7/2008 Vick, Jr. ..... F16K 31/086 251/65
2009/0218096 A1 * 9/2009 Vick, Jr. ..... F16K 31/1221 166/250.15
2009/0229814 A1 * 9/2009 Going, III ..... E21B 34/066 166/66.4
2010/0025045 A1 2/2010 Lake et al.
2011/0037004 A1 2/2011 Lake et al.
2011/0088907 A1 4/2011 Xu
2011/0120727 A1 * 5/2011 Lake ..... E21B 34/066 166/375
2011/0120728 A1 5/2011 Lake et al.
2011/0186303 A1 * 8/2011 Scott ..... E21B 34/066 166/373
2011/0240299 A1 * 10/2011 Vick, Jr. ..... E21B 34/10 166/321
2012/0125597 A1 * 5/2012 Vick, Jr. ..... E21B 34/066 166/66.5
2013/0105149 A1 * 5/2013 Williamson, Jr. ..... E21B 34/14 166/250.01
2013/0126154 A1 * 5/2013 Williamson, Jr. .... E21B 34/066 166/65.1
2014/0020887 A1 * 1/2014 Vick, Jr. ..... E21B 34/066 166/66.5
2015/0198011 A1 * 7/2015 Williamson, Jr. .... E21B 34/066 166/250.01
2019/0203564 A1 * 7/2019 Henschel, Jr. ..... E21B 34/066
2020/0032616 A1 * 1/2020 Vick, Jr. ..... E21B 34/14
2020/0095843 A1 * 3/2020 Vick, Jr. ..... E21B 34/066

* cited by examiner 200
204
205
216
210
218
232
212
226
228
224
220
242
234
225
203
206
202
208
222
240
230
214
223

200
204
216
210
218
232
212
228
224
226
220
244
242
206
202
222
208
212
230
214
236
238

200
204
210
232
212
222
208
218
230
236
238

ELECTRIC SAFETY VALVE WITH WELL PRESSURE ACTIVATION

CROSS REFERENCE TO RELATED APPLICATIONS

The present application claims benefit of U.S. Provisional Patent Application No. 62/703,506 filed Jul. 26, 2018, incorporated herein by reference.

BACKGROUND

Well safety valves may be installed in a wellbore to prevent uncontrolled release of reservoir fluids. Safety valves are typically hydraulically actuated by a series of hydraulic lines comprising a control line and a balance line. The control line may extend from the valve to the surface of the wellhead and from the wellhead to a subsea completion or to an offshore drilling or production platform. The balance line may be used to balance the control line hydrostatic pressure negating the effect of hydrostatic pressure from the control line. A typical safety valve may be operated by displacing a piston of the safety valve in response to a differential between pressure in the control line connected to the safety valve and pressure in a tubing string in which the safety valve is interconnected. Additionally, the balance line extending from a point in the ocean to the back side of the piston may provide an upward force on the piston to balance the pressure exerted on the piston with the control line or annulus pressure if the control line is compromised.

However, there may be limitations to placement and actuation of hydraulically actuated safety valves. Some constrains may include limitations with regards to hydrostatics requiring complex and expensive control schemes and fluid friction which may cause the valve to actuate slowly. A safety valve should ideally close as quickly as possible during a process upset or in the event of an emergency to ensure operational and environmental safety.

BRIEF DESCRIPTION OF THE DRAWINGS

These drawings illustrate certain aspects of some examples of the present disclosure and should not be used to limit or define the disclosure.

DETAILED DESCRIPTION

Provided are methods and apparatus comprising an electrically actuated well safety valve. The electrically actuated safety valve may be actuated using well pressure without the need for additional hydraulic control and balance lines. By eliminating hydraulic control and balance lines, the electrically actuated well safety valve may have increased failsafe ability as compared to other safety valves. Failsafe may be defined as a condition in which in the valve or associated control system may be damaged and the electrically actuated safety valve retains the ability to close. In some examples, the electrically actuated safety valve may fail in a closed position, thus ensuring that wellbore fluids and pressure are contained. In another example, the electrically actuated safety valve may close automatically when an electrical connection to the valve is disconnected without any additional external input.

Figure 1:
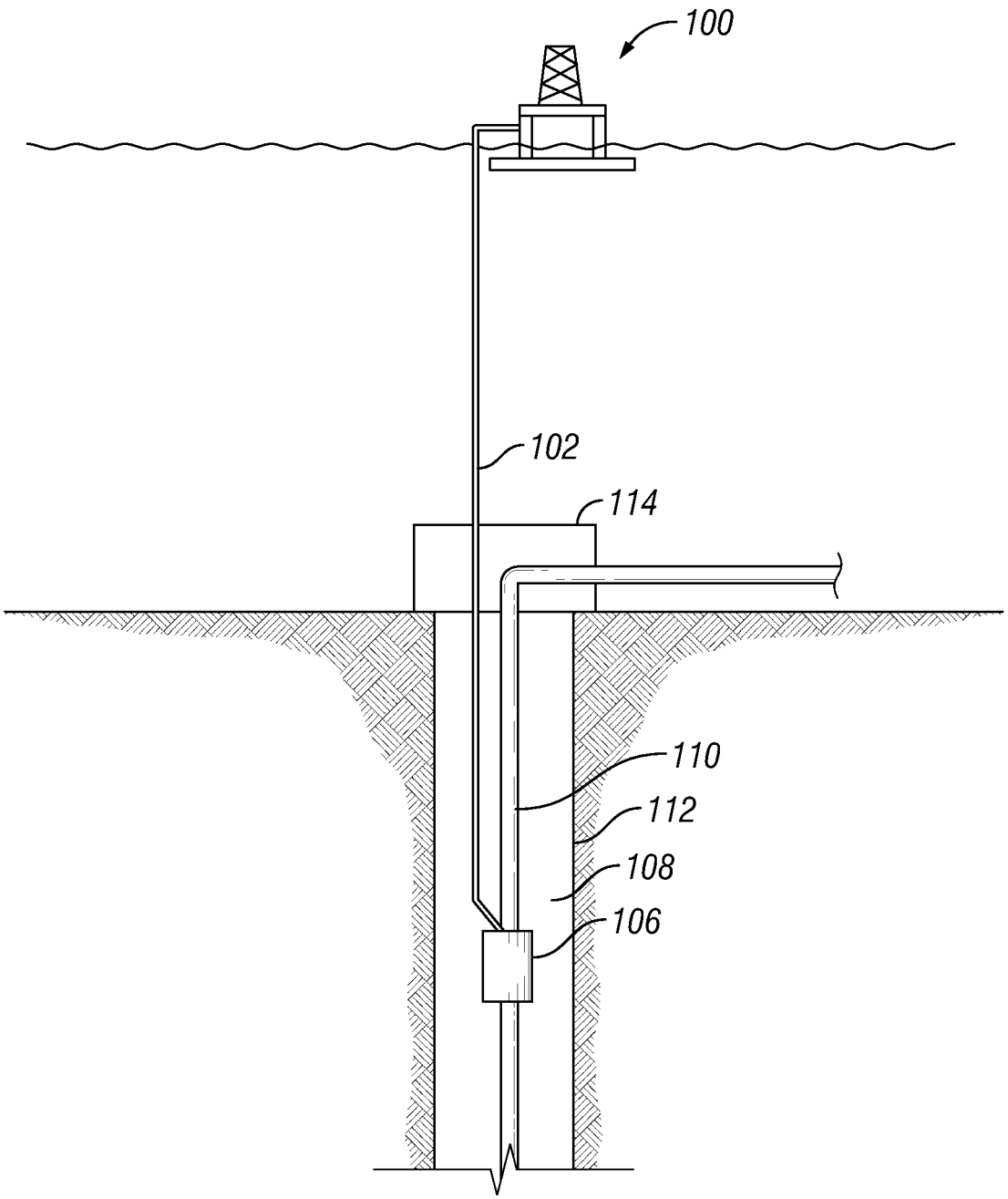
FIG. 1 is a diagram of an offshore well having an electrically actuated safety valve.

FIG. 1 illustrates an offshore platform 100 connected to an electrically actuated safety valve 106 via electrical connection 102. An annulus 108 may be defined between walls of well 112 and a conduit 110. Wellhead 114 may provide a means to hand off and seal conduit 110 against well 112 and provide a profile to latch a subsea blowout preventer to. Conduit 110 may be coupled to wellhead 114. Conduit 110 may be any conduit such as a casing, liner, production tubing, or other tubulars disposed in a wellbore. In the following description of electrically actuated safety valve 106 and other apparatus and methods described herein, directional terms, such as "above", "below", "upper", "lower", etc., are used only for convenience in referring to the accompanying drawings. Additionally, it is to be understood that the various examples of the present electrically actuated safety valve described herein may be utilized in various orientations, such as inclined, inverted, horizontal, vertical, etc., and in various configurations, without departing from the principles of the present disclosure. Although electrically actuated safety valve 106 is illustrated as being disposed within an offshore well, one of ordinary skill in the art will appreciate that electrically actuated safety valve 106 may be disposed in any type of wellbore including onshore and offshore type wellbores without deviating from the present disclosure. Furthermore, while electrical connection 102 is illustrated as being connected to an offshore platform, electrical connection 102 may be connected to any type of offshore completion without departing from the disclosure.

Electrically actuated safety valve 106 may be interconnected in conduit 110 and positioned in well 112. Electrically actuated safety valve 106 may provide a means to isolate a lower portion of conduit 110 from an upper portion of conduit 110. The lower portion of conduit 110 may be fluidically connected to a subterranean formation such that formation fluids may flow into the lower portion of conduit 110. Although well 112 as depicted in FIG. 1 is an offshore well, one of ordinary skill should be able to adopt the teachings herein to any type of well including onshore or offshore, Electrical connection 102 may extend into the well 112 and may be connected to electrically actuated safety valve 106. Electrical connection 102 may provide power to an electromagnet disposed within electrically actuated safety valve 106. As will be described in further detail below, power provided to the electromagnet may energize the electromagnet to hold components of electrically actuated safety valve 106 in place when electrically actuated safety valve 106 is actuated into an open position. Actuation may include opening electrically actuated safety valve 106 to provide a flow path for wellbore fluids in a lower portion of conduit 110 to flow into an upper portion of conduit 110. Electrical connection 102 may also provide a means to close electrically actuated safety valve 106 and isolate a lower portion of conduit 110 to flow from an upper portion of conduit 110 to provide well control.

Figures 2A, 2B, 2C:
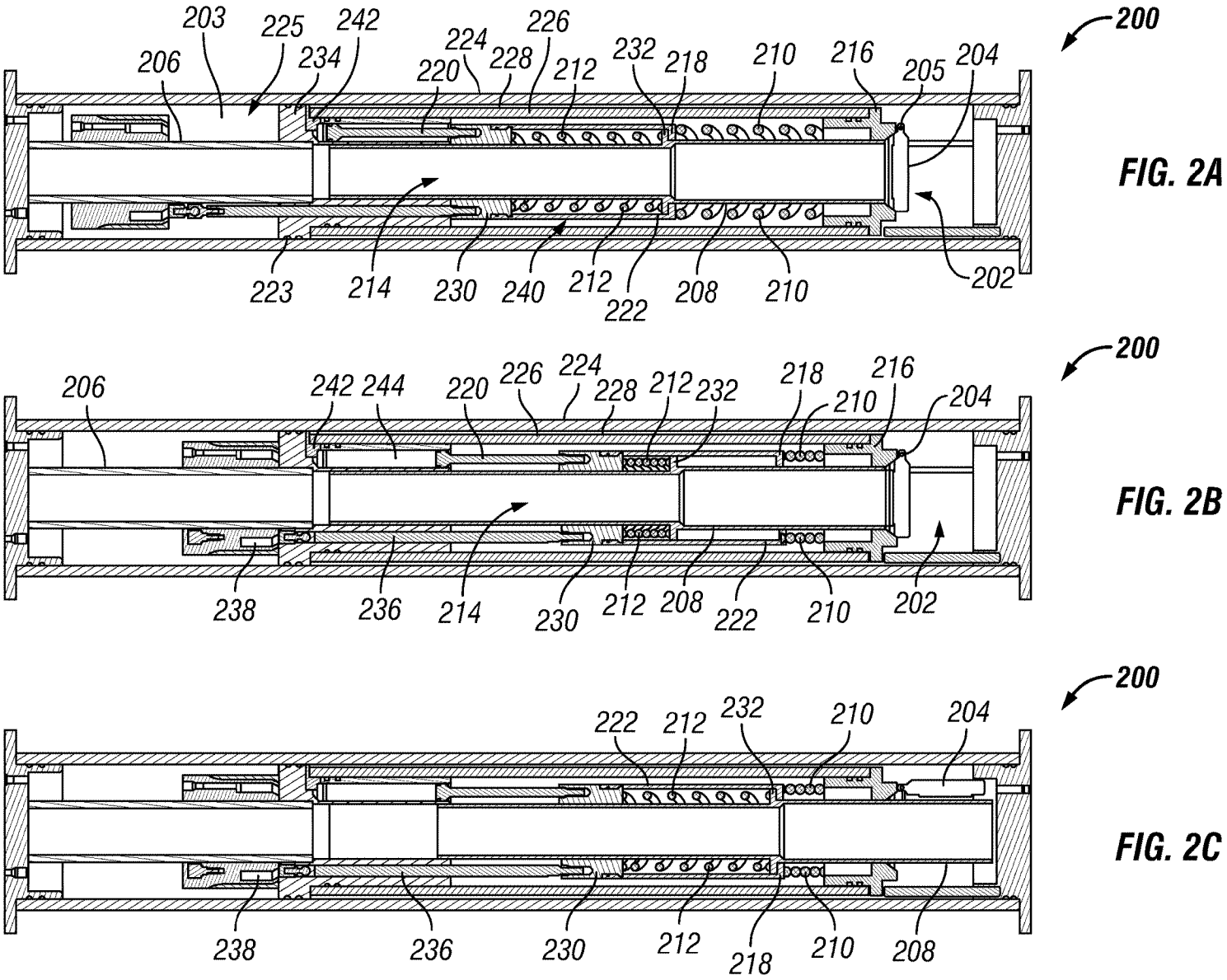
FIG. 2*a* is a schematic of an electrically actuated safety valve in a first closed position.
FIG. 2*b* is a schematic of an electrically actuated safety valve in a second closed position.
FIG. 2*c* is a schematic of an electrically actuated safety valve in an open position.

Referring to FIG. 2*a*, an example of an electrically actuated safety valve 200 is illustrated in a first closed position. Electrically actuated safety valve 200 may include body 224 containing bore 225 therein wherein components of the electrically actuated safety valve may be disposed within bore 225. Upper valve assembly 234 may be attached to body 224 and may further include sealing element 223 such that fluid communication from lower section 202 to upper section 203 is prevented. Sleeve 226 may be attached to upper valve assembly 234 and lower valve assembly 216. Flow tube 240 may be disposed within sleeve 226. Flow tube 240 may include translating sleeve 222 and flow tube main body 208. A flow path 214 may be defined by an interior of flow tube main body 208. As illustrated in FIG. 2*a*, flow path 214 may extend from an interior of conduit 206 through an interior of flow tube main body 208. As will be discussed in further detail below, when electrically actuated safety valve 200 is in an open position, flow path 214 may extend from an interior of conduit 206 through an interior of flow tube main body 208 and further into lower section 202.

Power spring 210 may be disposed between lower valve assembly 216 and translating sleeve shoulder 218. As illustrated in FIG. 2*a*, translating sleeve shoulder 218 and flow tube shoulder 232 may be in contact when electrically actuated safety valve 200 is in the first closed position. Power spring 210 may provide a positive spring force against translating sleeve shoulder 218 which may keep flow tube main body 208 in a first position. Power spring 210 may also provide a positive spring force to return flow tube main body 208 and translating sleeve 222 to the first position from a second position as will be explained below. A nose spring 212 may be disposed between translating sleeve assembly 230 and flow tube shoulder 232. Translating sleeve assembly 230 may be disposed between and attached to piston 220 and translating sleeve 222. Although only one piston is illustrated in FIGS. 2*a*-2*c*, there may be multiple pistons attached to translating sleeve 222. Power spring 210 and nose spring 212 are depicted as coiled springs in FIGS. 2*a*-2*c*. However, power spring 210 and nose spring 212 may include any kind of spring such as, for example, coil springs, wave springs, or fluid springs. Translating sleeve assembly 230 which may allow a force applied to a distal end of piston 220 to be transferred into translating sleeve 222. A force may be applied to the distal end of piston 220 by way of fluid communication from channel 228 through orifice 242. A force applied to piston 220 may move translating sleeve 222 from a first position to a second position. Nose spring 212 may provide a positive spring force against translating sleeve assembly 230 and flow tube shoulder 232 which may move translating sleeve 222 from the second position to the first position as will be discussed in greater detail below.

In the first closed position, translating sleeve 222 and flow tube main body 208 are positioned such that translating sleeve shoulder 218 and flow tube shoulder 232 are in contact and power spring 210 and nose spring 212 are in an extended position. In the first closed position, translating sleeve 222 may be referred to as being in a first position and flow tube 208 may be referred to as being in a first position.

Electrically actuated safety valve 200 may be disposed in a wellbore as part of a wellbore completion string. The wellbore may penetrate a subterranean formation that contains formation fluids such as oil, gas, water, or any combination thereof. Formation fluids may flow from the subterranean formation into the wellbore and thereafter into a lower portion of conduit 110 as discussed above. Lower section 202 may be fluidically coupled to a lower portion of conduit 110 and therefore may be exposed to formation fluids and pressure as a function of being in fluid communication with fluids present in the wellbore. Lower section 202 may be fluidically coupled to a production tubing string disposed of in the wellbore, for example. In the first closed position, valve 204 may be in a closed position thereby isolating lower section 202 from flow tube main body 208. When valve 204 is in a closed position as in FIG. 2*a*, valve 204 may prevent formation fluids and pressure from flowing into flow tube main body 208. Although FIG. 2*a* illustrates valve 204 as a flapper valve, valve 204 may be any suitable type of valve such as a flapper type valve or a ball type valve, for example. As will be illustrated in further detail below, valve 204 may be actuated into an open position to allow formation fluids to flow from lower section 202 through a flow path 214 defined by lower section 202, an interior of flow tube main body 208 and an interior of conduit 206. Conduit 206 may be coupled to an upper portion of conduit 110 shown in FIG. 1.

When electrically actuated safety valve 200 is in the first closed position, no amount of differential pressure across valve 204 will allow formation fluids to flow from lower section 202 into flow path 214. In the first closed position, electrically actuated safety valve 200 will only allow fluid flow from conduit 206 into lower section 202 but not from lower section 202 into conduit 206. In the instance that pressure in conduit 206 is increased, valve 204 will remain in the closed position until the pressure in conduit 206 is increased above the pressure in lower section 202 plus the closing pressure provided by flapper spring 205, sometimes referred to herein as valve opening pressure. When the valve opening pressure is reached, valve 204 may open and allow fluid communication from conduit 206 into lower section 202. In this manner treatment fluids such as surfactants, scale inhibitors, hydrate treatments, and other suitable treatment fluids may be introduced into the subterranean formation. The configuration of electrically actuated safety valve 200 may allow treatment fluids to be pumped from a surface, such as a wellhead, into the subterranean formation without actuating a control line or balance line to open the valve. Once pressure in conduit 206 is decreased below the valve opening pressure, flapper spring 205 may cause valve 204 to return to the closed position and flow from conduit 206 into lower section 202 may cease. When valve 204 has returned to the closed position flow from lower section 202 into flow path 214 may be prevented. Should a pressure differential across valve 204 be reversed such that pressure in lower section 202 is greater than a pressure in conduit 206, valve 204 may remain in a closed position such that fluids in the lower section 202 are prevented from flowing into conduit 206.

With reference to FIG. 2*b* electrically actuated safety valve 200 is illustrated in a second closed position. In the second closed position, translating sleeve 222 may be displaced from the first position to a second position which is relatively closer in proximity to valve 204. Flow tube main body 208 may remain in the first position. When the electrically actuated safety valve 200 is in the second closed position, both power spring 210 and nose spring 212 may be in a compressed state.

To move translating sleeve 222 to the second position, differential pressure across valve 204 may be increased by lowering pressure in conduit 206 or increasing pressure in lower section 202. Lowering pressure in conduit 206 or increasing pressure in lower section 202 may cause fluid from lower section 202 to flow through channel 228 defined between sleeve 226 and body 224 into orifice 242. Orifice 242 may allow fluid communication into piston tube 244 whereby fluid pressure may act on the proximal end of piston 220. The force exerted by fluid pressure on the proximal end of piston 220 may displace piston 220 towards valve 204 by transferring the force through piston 220, translating sleeve assembly 230, and translating sleeve shoulder 218. Nose spring 212 may provide a spring force against flow tube shoulder 232 and translating sleeve assembly 230 and power spring 210 may provide a spring force against translating sleeve shoulder 218 and lower valve assembly 216. Although not illustrated in FIGS. 2*a*-2*c*, flow tube main body 208 may include channels that allow pressure and/or fluid communication between flow path 214 and an interior of sleeve 226. Collectively the spring forces from power spring 210 and nose spring 212 may resist the movement of piston 220 until the differential pressure across valve 204 is increased beyond the spring force provided from power spring 210 and nose spring 212. Increasing differential pressure may include decreasing pressure in flow tube 206 such that pressure in lower section 202 is relatively higher than the pressure in flow tube 206. When the differential pressure across valve 204 is increased, the differential pressure across piston 220 also increases. When the differential pressure across valve 204 is increased beyond the spring force provided by nose spring 212 and power spring 210, nose spring 212 and power spring 210 may compress and allow translating sleeve 222 to move into the second position. Differential pressure across valve 204 may be increased by pumping fluid out of conduit 206, for example. In the instance that lower section 202 is fluidically coupled to a non-perforated section of pipe or where there is a plug in a conduit fluidically coupled to lower section 202 that prevents pressure being transmitted from lower section 202 to piston 220, a pressure differential across valve 204 may be induced through pipe swell.

In the second closed position, electrically actuated safety valve 200 remains safe as no fluids from lower section 202 can flow into flow path 214. In the second closed position no amount of differential pressure across valve 204, the differential pressure being relatively higher pressure in lower section 202 and relatively lower pressure in conduit 206, should cause valve 204 to open to allow fluids from lower section 202 to flow into flow path 214 as the pressure from lower section 204 is acting on valve 204. If pressure is increased in conduit 206, the differential pressure across valve 204 decreases and translating sleeve 222 may move back to the first position illustrated in FIG. 2*a*. Unlike conventional safety valves which generally require a control line to supply pressure to actuate a piston to move a translating sleeve, electrically actuated safety valve 200 only requires pressure supplied by the wellbore fluids in lower section 202 to move the translating sleeve.

With continued reference to FIG. 2*b*, piston 236 may be fixedly attached to translating sleeve assembly 230 and electromagnet assembly 238. Although illustrated as two pistons in FIGS. 2*a*-2*c*, piston 236 may be an integral component of piston 220. As illustrated, when translating sleeve 222 is moved from the first position to the second position, piston 236 and electromagnet assembly 238 may also be moved, After translating sleeve 222 is allowed to come to the second position as described above, electromagnet assembly 238 may be powered on. Powering electromagnet assembly 238 may cause the electromagnet assembly 238 to become fixed in place on conduit 206 or another magnetic part of electrically actuated safety valve 200. In FIGS. 2*a*-2*c*, electromagnet assembly 238 is depicted as one coil circumscribing translating sleeve assembly 230 but there may be any number of coils in any orientation to fix translating sleeve assembly 230 in place. Electromagnet assembly 238 may apply a force in a substantially axial direction, for example. The force applied by electromagnet assembly 238 may be any amount of force, including but not limited to, a force in a range of about 45 Newtons to about 45000 Newtons. As electromagnet assembly 238 is attached to translating sleeve assembly 230 through piston 236, when electromagnet assembly 238 is switched on and fixed in place, translating sleeve assembly 230 and translating sleeve 222 may also become fixed in place thereby preventing translating sleeve 222 from moving from the second position back to the first position. Electromagnets may provide a means to hold translating sleeve 222 at any well depth. Hydraulic systems used in previous wellbore safety valves generally require control and balance lines to actuate and hold a valve open which may have pressure limitations. The limitations experienced by hydraulic systems may be overcome by using the electromagnet assembly described herein as only well pressure is required to open electrically actuated safety valve 200. Again, when translating sleeve 222 is in the second position either when electromagnet assembly 238 is switched on or switched off, no amount of differential pressure across valve 204 will open valve 204, the differential pressure being a pressure difference between a relatively higher pressure in section 202 and a relatively lower pressure in conduit 206.

With reference to FIG. 2*c*, electrically actuated safety valve 200 is illustrated in an open position. When electrically actuated safety valve 200 is in the open position, translating sleeve 222 may be fixed in place in the second position as in FIG. 2*b* through the force provided by electromagnet assembly 238, the force being transferred through piston 236 to translating sleeve assembly 230. Flow tube main body 208 is illustrated as being axially shifted from the first position illustrated in FIGS. 2*a* and 2*b* to a second position in FIG. 2*c*. When flow tube main body 208 is in the second position, flow tube shoulder 232 and translating sleeve shoulder 218 may be in contact and flow tube main body 208 may have displaced valve 204 into an open position. Nose spring 212 may be in an uncompressed state while power spring 210 may be in a compressed state.

Flow tube main body 208 may be moved from the first position to the second position when translating sleeve 222 is fixed in place in the second position by electromagnet assembly 238 as described above. When translating sleeve 222 is fixed in the second position through the force provided by electromagnet assembly 238, nose spring 212 may provide a positive spring force against flow tube shoulder 232 and translating sleeve assembly 230. The positive spring force from nose spring 212 may be transferred through flow tube main body 208 into valve 204. Flow tube main body 208 will not move to the second position until differential pressure across valve 204 is decreased after translating sleeve 222 is fixed in position. Differential pressure may be decreased by pumping into conduit 206 thereby increasing the pressure in conduit 206. Pressure may be increased in conduit 206 until the differential pressure across valve 204 is decreased to a point where the positive spring force from nose spring 212 is greater than the differential pressure across valve 204. Thereafter, nose spring 212 may extend and move flow tube main body 208 into the second position by acting on acting on translating sleeve assembly 230 and flow tube shoulder 232. When flow tube main body 208 is in the second position, fluids such as oil and gas in lower section 202 may be able to flow into flow path 214 and to a surface of the wellbore such as to a wellhead. Electrically actuated safety valve 200 may remain in the open position defined by translating sleeve 222 being in the second position and flow tube 208 being in the second position if electromagnet assembly 238 remains powered on.

Electrically actuated safety valve 200 may be moved back to the first closed position as illustrated in FIG. 1 by powering off electromagnet assembly 238. As previously discussed, electromagnet assembly 238 may fix translating sleeve assembly 230 in place in the second position when the electromagnet assembly 238 remains powered on. When electromagnet assembly 238 is powered off, translating sleeve assembly 230 may no longer be fixed in place. Power spring 210 may provide a positive spring force against lower valve assembly 216, translating sleeve shoulder 218, and flow tube shoulder 232 through contact between translating sleeve shoulder 218 and flow tube shoulder 232. The positive spring force from power spring 210 may axially displace translating sleeve 222 to the first position and flow tube main body 208 to the first position thereby returning electrically actuated safety valve 200 to the first closed position illustrated in FIG. 1. Positive spring force from power spring 210 may axially displace electromagnet assembly 238 to the position illustrated in FIG. 2*a* by transmitting the positive spring force through piston 236.

Figure 3:
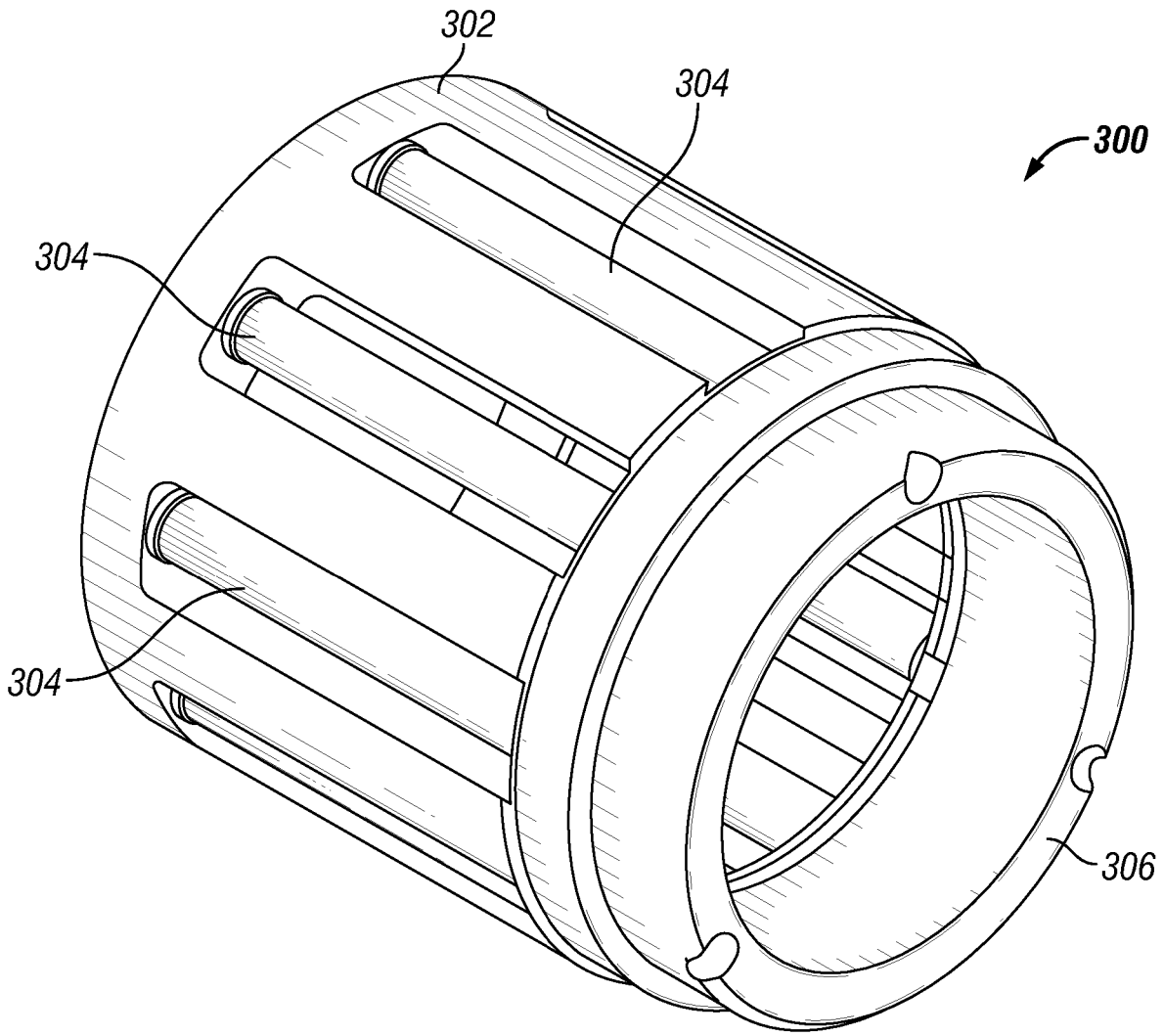
FIG. 3 is a schematic of an electromagnet assembly.

Referring to FIG. 3, an electromagnet assembly 300 is illustrated. Electromagnet assembly 300 may include housing 302 and at least one electromagnetic coil 304. As depicted in FIG. 3, there may be a plurality of electromagnetic coils 304 for redundancy. When a current is passed through plurality of electromagnetic coils 304, a magnetic force may be generated that attracts plurality of electromagnetic coils 304 to a target 306. Target 306 may be any part of the electrically actuated safety valve previously described. Plurality of electromagnetic coils 304 may be disposed within and fixedly attached to housing 302. housing 302 may be part of the electromagnetic circuit by having a relative magnetic permeability greater than 10. Housing 302 may be encapsulated or clad in a second material in order to minimize corrosion. Plurality of electromagnetic coils 304 may be wired in parallel or in series such that if one of the plurality of electromagnetic coils 304 fails by short circuiting or experiences an open circuit, the remaining plurality of electromagnetic coils 304 may function normally, i.e., the remaining plurality of electromagnetic coils 304 may be considered a redundant coil system.

A process control system may be utilized to monitor and control production of formation fluids from a well where the electrically actuated safety valve is disposed. A process control system may include components such as flowmeters, pressure transducers, pumps, power systems, and associated controls system for each. The process control system may provide power to the electrically actuated safety valve to turn on and off the electromagnet assembly therein. The electromagnet assembly may be designed to run off any power source such as alternating current ("A/C") or direct current ("D/C"). The process control system may allow an operator to open the electrically actuated safety valve by the methods described above by using the pump to reduce pressure, powering the electromagnet assembly, and using the pump to increase pressure. Wellbore fluid pressures and flow rates may be monitored by the process control system to ensure safe operating conditions and that the production process does not exceed safety limitations. Should a process upset occur such as an overpressure event, the process control system may detect the process upset and automatically cut power to the electrically actuated safety valve. As discussed above, cutting power to the electrically actuated safety valve may cause the electrically actuated safety valve to automatically close thereby containing pressures and fluids.

The disclosure may follow any of the following statements:

Statement 1. A safety valve comprising: an outer housing comprising a central bore extending axially through the outer housing; a flow tube comprising: a translating sleeve; and a flow tube main body disposed within the translating sleeve, wherein the flow tube main body has an upper end and a lower end; a piston operable to transmit a force to the translating sleeve; a flapper valve disposed on a distal end of the outer housing; and an electromagnet assembly operable to maintain the safety valve in an open state.

Statement 2. The safety valve of statement 1 wherein the translating sleeve and the flow tube main body are operable to move within the outer housing.

Statement 3. The safety valve of statement 2, wherein the translating sleeve further comprises a translating sleeve shoulder, wherein the flow tube main body comprises a flow tube shoulder, and wherein the flow tube shoulder is operable to engage with the translating sleeve shoulder to prevent the flow tube to move beyond the translating sleeve.

Statement 4. The safety valve of any of statements 2-3 further comprising a power spring disposed between the translating sleeve shoulder and a lower valve assembly, wherein the power spring is operable to provide a positive spring force against the translating sleeve shoulder.

Statement 5. The safety valve of any of statements 2-4 further comprising a nose spring disposed between the flow tube shoulder and a translating sleeve assembly, wherein the translating sleeve and translating sleeve assembly are fixedly attached.

Statement 6. The safety valve of any of statements 2-5 wherein the piston is fixedly attached to the translating sleeve assembly.

Statement 7. The safety valve of any of statements 2-6 wherein the electromagnet assembly is fixedly attached to the translating sleeve assembly by a second piston.

Statement 8. A method of actuating a safety valve comprising: moving a translating sleeve using well pressure from a first translating sleeve position to a second translating sleeve position, the translating sleeve being disposed within an outer housing comprising a central bore extending axially through the outer housing; locking in place the translating sleeve in the second translating sleeve position by providing a force from an electromagnet assembly; and moving a flow tube main body from a first flow tube main body position to a second flow tube main body position, the flow tube main body being disposed within the translating sleeve, wherein moving the flow tube main body from the first flow tube main body position to the second flow tube main body position displaces a flapper valve from a closed position to an open position.

Statement 9. The method of statement 8 wherein the step of moving the translating sleeve using well pressure comprises decreasing a pressure within the flow tube main body, allowing the well pressure to transmit a force to the translating sleeve, and moving the translating sleeve to the second translating sleeve position.

Statement 10. The method of any of statements 8-9 wherein decreasing pressure in the flow tube main body comprises pumping fluid out of the flow tube main body or swelling a conduit above the flow tube main body.

Statement 11. The method of any of statements 8-10 wherein the well pressure transmits the force through a piston, the piston being operable to move the translating sleeve.

Statement 12. The method of any of statements 8-11 wherein the step of locking in place the translating sleeve in the second translating sleeve position comprises providing power to the electromagnet assembly and using a magnetic force provided by the electromagnet assembly to prevent movement of a second piston, the second piston being operable to prevent movement of the translating sleeve from the second translating sleeve position.

Statement 13. The method of any of statements 8-12 wherein the step of moving the flow tube main body from the first flow tube main body position to the second flow tube main body position comprises increasing a pressure in the flow tube main body and causing a nose spring to push the flow tube main body into the flapper valve thereby opening the flapper valve.

Statement 14. The method of any of statements 8-13 wherein the translating sleeve further comprises a translating sleeve shoulder and the flow tube main body comprises a flow tube shoulder, wherein the flow tube shoulder and the translating sleeve shoulder are in contact when the flow tube main body is in the second flow tube main body position.

Statement 15. The method of any of statements 8-14 wherein the step of moving the flow tube from the first flow tube main body position to the second flow tube main body position comprises increasing a pressure in the flow tube main body such that the pressure in the flow tube main body and a positive spring force acting on a flow tube shoulder provided by a nose spring overcome a differential pressure across the flapper valve, thereby moving the flow tube to the second flow tube position.

Statement 16. A system comprising: a safety valve disposed in a wellbore, wherein the safety valve comprises a translating sleeve, the translating sleeve being operable to move by well pressure; and a process control system operable to actuate the safety valve from a closed position to an open position, the process system comprising: a pump; and an electrical connection to the safety valve operable to provide electrical power to the safety valve.

Statement 17. The system of statement 16 wherein the safety valve further comprises: an outer housing comprising a central bore extending axially through the outer housing, wherein the translating sleeve is disposed in the central bore; a flow tube is disposed within the translating sleeve; a piston operable to transmit a force to the translating sleeve; a flapper valve disposed on a distal end of the outer housing; and an electromagnet assembly operable to prevent the translating sleeve from moving.

Statement 18. The system of any of statements 16-17 wherein the electromagnet assembly comprises at least one coil.

Statement 19. The system of any of statements 16-18 wherein the process system further comprises a pressure transducer, a flowmeter, or a combination thereof.

Statement 20. The system of any of statements 16-19 wherein the process system is operable to detect a process upset and cut power to the safety valve.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A safety valve comprising:

an outer housing comprising a central bore extending axially through the outer housing;

a flow tube comprising:

a translating sleeve; and a flow tube main body disposed within the translating sleeve, wherein the flow tube main body has an upper end and a lower end;

a piston operable to transmit a force to the translating sleeve;

a flapper valve disposed on a distal end of the outer housing; and an electromagnet assembly operable to maintain the safety valve in an open state, the electromagnet assembly comprising a tubular housing coaxially aligned with the outer housing, and at least one coil attached to the tubular housing, the electromagnet assembly operable to move within the safety valve, the at least one coil operable to generate a magnetic force to fix the electromagnet assembly in place to hold the translating sleeve in place.

2. The safety valve of claim 1 wherein the piston is coupled to the electromagnet assembly.

3. The safety valve of claim 2, wherein the piston and the electromagnet assembly are operable to move due to fluid pressure.

4. The safety valve of claim 3 further comprising a power spring disposed between a translating sleeve shoulder and a lower valve assembly, wherein the power spring is operable to provide a positive spring force against the translating sleeve shoulder.

5. The safety valve of claim 3 further comprising a nose spring disposed between a flow tube shoulder and a translating sleeve assembly, wherein the translating sleeve and the translating sleeve assembly are fixedly attached.

6. The safety valve of claim 5 wherein the piston is fixedly attached to the translating sleeve assembly.

7. The safety valve of claim 5 wherein the electromagnet assembly is fixedly attached to the translating sleeve assembly by a second piston.

8. A method of actuating a safety valve comprising:

moving a translating sleeve using well pressure from a first translating sleeve position to a second translating sleeve position, the translating sleeve being disposed within an outer housing comprising a central bore extending axially through the outer housing;

locking in place the translating sleeve in the second translating sleeve position by providing a force from an electromagnet assembly; and moving a flow tube main body from a first flow tube main body position to a second flow tube main body position, the flow tube main body being disposed within the translating sleeve, wherein moving the flow tube main body from the first flow tube main body position to the second flow tube main body position displaces a flapper valve from a closed position to an open position, wherein the step of moving the flow tube main body from the first flow tube main body position to the second flow tube main body position comprises increasing a pressure in the flow tube main body and causing a nose spring to push the flow tube main body into the flapper valve thereby opening the flapper valve.

9. The method of claim 8 wherein the step of moving the translating sleeve using well pressure comprises decreasing a pressure within the flow tube main body, allowing the well pressure to transmit a force to the translating sleeve, and moving the translating sleeve to the second translating sleeve position.

10. The method of claim 9 wherein decreasing pressure in the flow tube main body comprises pumping fluid out of the flow tube main body or swelling a conduit above the flow tube main body.

11. The method of claim 9 wherein the well pressure transmits the force through a piston, the piston being operable to move the translating sleeve.

12. The method of claim 8 wherein the step of locking in place the translating sleeve in the second translating sleeve position comprises providing power to the electromagnet assembly and using a magnetic force provided by the electromagnet assembly to prevent movement of a second piston, the second piston being operable to prevent movement of the translating sleeve from the second translating sleeve position.

13. The method of claim 8, wherein the providing the force from the electromagnet assembly comprises applying the force in an axial direction, the electromagnet assembly comprising a tubular housing coaxially aligned with the outer housing, and at least one coil attached to the tubular housing.

14. The method of claim 8, wherein the translating sleeve further comprises a translating sleeve shoulder and the flow tube main body comprises a flow tube shoulder, wherein the flow tube shoulder and the translating sleeve shoulder are in contact when the flow tube main body is in the second flow tube main body position.

15. A method of actuating a safety valve comprising:

moving a translating sleeve using well pressure from a first translating sleeve position to a second translating sleeve position, the translating sleeve being disposed within an outer housing comprising a central bore extending axially through the outer housing;

locking in place the translating sleeve in the second translating sleeve position by providing a force from an electromagnet assembly; and moving a flow tube main body from a first flow tube main body position to a second flow tube main body position, the flow tube main body being disposed within the translating sleeve, wherein moving the flow tube main body from the first flow tube main body position to the second flow tube main body position displaces a flapper valve from a closed position to an open position, wherein the step of moving the flow tube from the first flow tube main body position to the second flow tube main body position comprises increasing a pressure in the flow tube main body such that the pressure in the flow tube main body and a positive spring force acting on a flow tube shoulder provided by a nose spring overcome a differential pressure across the flapper valve, thereby moving the flow tube to the second flow tube position.

16. A system comprising:

a safety valve disposed in a wellbore, wherein the safety valve comprises a translating sleeve, the translating sleeve being operable to move by well pressure;

an electromagnet assembly operable to prevent the translating sleeve from moving, the electromagnet assembly comprising a tubular housing coaxially aligned with the outer housing, and at least one coil attached to the tubular housing, the electromagnet assembly operable to move within the safety valve, the at least one coil operable to generate a magnetic force to fix the electromagnet assembly in place to hold the translating sleeve in place; and a process control system operable to actuate the safety valve from a closed position to an open position, the process system comprising:

a pump; and an electrical connection to the safety valve operable to provide electrical power to the safety valve.

17. The system of claim 16 wherein the safety valve further comprises:

an outer housing comprising a central bore extending axially through the outer housing, wherein the translating sleeve is disposed in the central bore;

a flow tube is disposed within the translating sleeve;

a piston operable to transmit a force to the translating sleeve; and a flapper valve disposed on a distal end of the outer housing.

18. The system of claim 17, wherein the at least one coil extends axially.

19. The system of claim 16 wherein the process system further comprises a pressure transducer, a flowmeter, or a combination thereof.

20. The system of claim 16 wherein the process system is operable to detect a process upset and cut power to the safety valve.

* * * * *